US005547806A

United States Patent [19]

Kamikawa et al.

[11] Patent Number: 5,547,806

[45] Date of Patent: Aug. 20, 1996

[54] PROCESS FOR PRODUCING MICROCAPSULE CONTAINING DIAZONIUM SALT COMPOUND AND PHOTO- AND HEAT-SENSITIVE RECORDING MATERIAL PRODUCED USING THE SAME

[75] Inventors: Hiroshi Kamikawa; Sadao Ishige, both of Shizuoka, Japan

[73] Assignee: Fuji Photo Film Co., Ltd., Kanagawa, Japan

[21] Appl. No.: 360,263

[22] Filed: Dec. 21, 1994

[30] Foreign Application Priority Data

Dec. 21, 1993 [JP] Japan ..... 5-322574

[51] Int. Cl.[6] ..... G03C 1/72

[52] U.S. Cl. ..... 430/138; 430/168; 430/169

[58] Field of Search ..... 430/138, 168, 430/169

[56] References Cited

FOREIGN PATENT DOCUMENTS 6297856 10/1994 Japan .

*Primary Examiner*—Charles L. Bowers, Jr.

*Assistant Examiner*—Christopher G. Young

*Attorney, Agent, or Firm*—Sughrue, Mion, Zinn, Macpeak & Seas

[57] ABSTRACT

The invention is directed to a process for producing microcapsules containing a diazonium salt compound by the steps of (i) adding a dialkyl sulfate compound represented by the formula: RO—$SO_2$—OR, where R is an alkyl or cycloalkyl group having up to 24 carbon atoms, to an organic solvent solution containing a diazonium salt compound and a polyfunctional isocyanate compound, (ii) emulsifying the resulting organic solvent solution into an aqueous solution of ,a water-soluble polymer, and then (iii) polymerizing the polyfunctional isocyanate compound to form microcapsule walls. The invention also discloses the recording material produced by the process.

18 Claims, No Drawings

PROCESS FOR PRODUCING MICROCAPSULE CONTAINING DIAZONIUM SALT COMPOUND AND PHOTO- AND HEAT-SENSITIVE RECORDING MATERIAL PRODUCED USING THE SAME

FIELD OF THE INVENTION

The present invention relates to a process for producing microcapsules containing a diazonium salt compound and to a photo- and heat-sensitive recording material produced using the same. More particularly, the present invention relates to a process for producing diazonium salt-containing microcapsules having improved stability of the microencapsulated diazonium salt, and to a photo- and heat-sensitive recording material produced using the same process which recording material is inhibited from developing an increase in background staining with the lapse of time.

BACKGROUND OF THE INVENTION

Diazonium salt compounds, having extremely high chemical activity, react with compounds such as phenol derivatives and compounds having an active methylene group (generally called couplers) to form azo dyes. Since diazonium salt compounds also are light sensitive and lose their activity upon irradiation with light, they are commonly utilized in photo-recording materials (see "Shashin Kōgaku No Kiso (Fundamental Photographic Technology)—Hi-ginen Shashin Hen (a volume of Non-Silver Halide Photography)," edited by Photographic Science and Technology Society of Japan, Corona Sha (1982) pp.89–117, pp.182–201). Due to these properties, diazonium salt compounds also have recently been applied to heat-sensitive recording materials. A photofixation-type heat-sensitive recording material has been proposed in which a diazonium salt compound is thermally reacted with a coupler to form an image, which image is then fixed by irradiation with light (e.g., Kōji Satō et at., Gazō Denshi Gakkai-shi (Journal of Image Electronics Society), Vol.11, No.4 (1982) pp.290–296). However, prior art recording materials employing diazonium salt compounds have a short shelf life because diazonium salt compounds gradually undergo pyrolysis, even in the dark, due to their extremely high activity. To overcome this drawback, a technique of microencapsulating a diazonium salt compound to thereby isolate the same from substances which accelerate pyrolysis, such as water or a base, has been proposed (Toshimasa Usami et al., Denshi Shashin Gakkai-shi (Journal of Electrophotographic Society), Vol.26, No.2 (1987) pp.115–125).

In a generally employed process for microencapsulation of a diazonium salt compound, the diazonium salt is dissolved in an organic solvent (oil phase), and the solution is added to and emulsified into an aqueous solution of a water-soluble polymer (aqueous phase). This emulsification is conducted in the presence of a monomer or prepolymer which is to be a wall material of the capsule. The monomer or prepolymer is added beforehand to either the organic solvent phase or the aqueous phase. As a result, polymer walls form at the interface between the organic solvent phase and the aqueous phase to produce microcapsules. Such methods are described in detail, e.g., in Asashi Kondō, "Microcapsule", Nikkan Kogyo Shinbun-sha (1970) and Tamotsu Kondō et al., "Microcapsule", Sankyō Shuppan (1977). For forming microcapsule walls, various materials can be used, such as gelatin, alginic acid salts, cellulose derivatives, urea resins, urethane resins, melamine resins, and nylon resins. Of these, urea resins and urethane resins are preferred from the standpoint of designing a heat-sensitive recording material. Namely, these resins have a glass transition point in the range of from room temperature (about 20–30° C.) to one hundred and several tens of ° C., so that microcapsule walls made of such materials are responsive to heat.

Diazonium salt compounds have high chemical activity and tend to readily undergo pyrolysis or hydrolysis. On the other hand, it is known that by microencapsulation, these compounds are isolated from highly reactive substances. As a result, the microencapsulated diazonium salt compounds are less sensitive to such highly reactive substances and therefore exhibit improved stability.

In the case of microcapsules having urea resin or urethane resin walls, a generally employed process for producing the microcapsules comprises first dissolving a diazonium salt in an organic solvent, adding an isocyanate compound thereto, emulsifying the resulting organic solvent solution into an aqueous solution of a water-soluble polymer, and then polymerizing the isocyanate compound by either adding a polymerization catalyst to the aqueous phase or elevating the temperature of the emulsion to thereby form capsule walls. This technique has succeeded in prolonging the shelf lives of photo- and heat-sensitive recording materials employing microcapsules containing a diazonium salt compound to about a few years, which recording materials have conventionally had a shelf life of less than one year. However, such photo- and heat-sensitive recording materials employing microcapsules containing a diazonium salt compound are defective in that background staining becomes severer with the lapse of time. In addition, the microencapsulated diazonium salt produced by the prior art technique still have insufficient stability.

As a result of intensive studies made by the present inventor, it has been found that the stability of a microencapsulated diazonium salt compound and the increased background staining with time in photo- and heat-sensitive recording materials employing microcapsules containing a diazonium salt compound vary depending on the additives used in the microencapsulation process, and that the addition of a specific additive imparts extremely good stability to the microencapsulated diazonium salt compound to produce a recording material which undergoes little increase in background staining with the lapse of time. The present invention has been achieved based on these findings. The effects of the present invention are pronounced in the case where the material of the capsule walls is a polyurea or a polyurethane (i.e., where a polyfunctional isocyanate is used as a material for the microcapsule walls).

SUMMARY OF THE INVENTION

An object of the present invention is to provide a process for producing microcapsules containing a diazonium salt compound, by which process improved stability is imparted to the microencapsulated diazonium salt compound and increase staining with the lapse of time is inhibited in photo- and heat-sensitive recording materials employing diazonium salt-containing microcapsules. Another object of the present invention is to provide a photo- and heat-sensitive recording material produced using the process.

The above objects of the present invention are accomplished with a process for producing microcapsules containing a diazonium salt compound which comprises adding a dialkyl sulfate compound to an organic solvent solution containing both the diazonium salt compound and a polyfunctional isocyanate compound, emulsifying the resulting organic solvent solution into an aqueous solution of a water-soluble polymer, and then polymerizing the polyfunctional isocyanate compound to form microcapsule walls, said dialkyl sulfate compound being represented by the following formula:

$$RO—SO_2—OR$$

wherein R represents an alkyl or cycloalkyl group having up to 24 carbon atoms.

DETAILED DESCRIPTION OF THE INVENTION

In the above formula, R is preferably an alkyl group having from 2 to 12 carbon atoms, more preferably an alkyl group having from 2 to 6 carbon atoms (e.g., ethyl, propyl, butyl). R may be substituted by an aryl group (e.g., phenyl, naphthyl), an alkoxy group (e.g., ethoxy, propoxy, butoxy), an aryloxy group (e.g., phenoxy, naphthoxy), an alkylthio group (e.g., octylthio), an arylthio group (e.g., phenylthio, p-toluylthio), a nitro group, or a halogen atom (e.g., fluorine, chlorine, bromine, iodine). When R is a substituted alkyl group, the total carbon atom number thereeof is preferably from 2 to 24.

Examples of the dialkyl sulfate compound of the present invention include diethyl sulfate, di-n-propyl sulfate, di-n-butyl sulfate, bis(2-ethylhexyl) sulfate, dilauryl sulfate, distearyl sulfate, bis(2-phenethyl) sulfate, bis(α-naphthylmethyl) sulfate, dibenzyl sulfate, bis(2-butoxyethyl) sulfate, bis(2-phenoxyethyl) sulfate, bis(2-octylthioethyl) sulfate, bis[2-(4-tolyl)thioethyl] sulfate, bis(4-nitroethyl) sulfate, bis(2-chloroethyl) sulfate, dicyclohexyl sulfate, bis(4-methylcyclohexyl) sulfate, bis(4-methoxycyclohexyl) sulfate, and bis(4-butylthiocyclohexyl) sulfate.

The dialkyl sulfate compound of the present invention is employed in an amount of desirably from 0.05 to 10 parts (parts by weight, hereinafter all parts are by weight), preferably from 0.2 to 3 parts, per 1 part of the diazonium salt. The effect of the dialkyl sulfate compound is pronounced when a xylylene diisocyanate/trimethylolpropane adduct (75wt% ethyl acetate solution) is used as a wall-forming agent.

Conventionally known diazonium salt compounds may be used in the present invention. The diazonium salt compound is a compound represented by the formula $$Ar—N_2^+X^-$$

(wherein Ar represents an aromatic residue (e.g., a benzene residue or a substituted benzene residue) and $X^-$ represents an acid anion (e.g., a halogen ion, a hexafluorophosphate ion, a tetraflyoroborate ion a 1,5-naphthalenesulfonate ion)).

The diazonium salt compound reacts with a phenol compound or a compound having an active methylene group to form an azo dye. Furthermore, it decomposes with the loss of nitrogen upon irradiation with light (generally ultraviolet) and, as a result, it loses its activity.

In general, diazonium salt compounds having a longer maximum absorption wavelength tend to have a lower thermal stability. Thus, the effects of this invention are pronounced for diazonium salt compounds having longer maximum absorption wavelengths. Specifically, the microencapsulation of a diazonium salt compound having a maximum absorption wavelength above 380 nm is effective. Examples of the diazonium salt compound include salts of 2,5-dibutoxy-4-morpholinobenzenediazonium, 2,5-dioctoxy-4-morpholinobenzenediazonium, 2,5-dibutoxy-4-(N-(2-ethylhexanoyl)piperazino)benzenediazonium, 2,5-diethoxy-4-(N-(2-(2,4-di-tert-amylphenoxy)butyryl)piperazino)benzenediazonium, 2,5-dibutoxy-4-tolylthiobenzenediazonium, 2,5-dibutoxy-4-chlorobenzenethiodiazonium, 3-(2-octyloxyethoxy)-4-morpholinobenzenediazonium, 4-N,N'-dihexylamino-2-hexyloxybenzenediazonium, and 4-N-hexyl-N'-tolylamino-2-hexyloxybenzenediazonium. For microencapsulation, these diazonium salt compounds are preferably oil-soluble, and salts in the form of a hexafluorophosphate, a tetrafluoroborate, and a 1,5-naphthalenesulfonate are preferred.

The organic solvent used for dissolving the diazonium salt compounds therein to form microcapsule cores preferably has a boiling point of from 40° to 300° C. Examples thereof include ethyl acetate, butyl acetate, methylene chloride, tetrahydrofuran, acetone, alkylnaphthalenes, alkyl adducts of diphenylethane, chlorinated paraffins, tricresyl phosphate, and di-2-ethylhexyl maleate. A mixture of two or more of these may be used. In the case where one or more low-boiling solvents (boiling point, about 100° C. or lower) alone are used for forming capsule cores, the solvents evaporate to produce so-called core-less capsules consisting of capsule walls in which only the diazo compound is present.

The polyfunctional isocyanate compound used as a material for microcapsules is preferably a compound having 3 or more isocyanate groups per molecule, which compound may be used in combination with a bifunctional isocyanate compound. Examples thereof include dimers or trimers (biurets or isocyanurates) produced mainly from such diisocyanates as xylylene diisocyanate and its hydrogenation product, hexamethylene diisocyanate, tolylene diisocyanate and its hydrogenation product, and isophorone diisocyanate. Examples thereof further include polyfunctional adducts of these diisocyanates with polyols such as trimethylolpropane and condensates of benzene isocyanate with formaldehyde. These materials are described in detail, e.g., in Keiji Iwata, "Polyurethane Resin Handbook," Nikkan Kogyo Shinbunsha (1987).

A polyol or polyamine may be used as one of the ingredients for forming microcapsule walls. In this case, the polyol or polyamine is added to the organic solvent serving as a core material or to the aqueous solution of the water-soluble polymer serving as a dispersion medium. Examples of the polyol or polyamine include propylene glycol, glycerol, trimethylolpropane, triethanolamine, sorbitol, and hexamethylenediamine. These materials are also described in detail in the "Polyurethane Resin Handbook" referred to above.

The oil phase thus prepared as an ingredient for forming capsules is dispersed into an aqueous solution of a water-soluble polymer. Examples of the water-soluble polymer include poly(vinyl alcohol) and modification products thereof, polyacrylamide and derivatives thereof, ethylenevinyl acetate copolymers, styrene-maleic anhydride copolymers, ethylene-maleic anhydride copolymers, isobutylene-maleic anhydride copolymers, polyvinylpyrrolidone, ethylene-acrylic acid copolymers, vinyl acetate-acrylic acid copolymers, carboxymethyl cellulose, methyl cellulose, casein, gelatin, starch derivatives, gum arabic, and sodium alginate. These water-soluble polymers preferably have no or low reactivity with isocyanate compounds. It is therefore necessary that when a reactive polymer such as, e.g., gelatin having reactive amino groups in the molecular chain is used, the polymer should be treated to remove such activity prior to use.

A surfactant may be used for emulsifying the oil phase into the aqueous phase. Surfactants that can be used in this emulsification are given, e.g., in "Kaimen Kassei-zai Binran (Handbook of Surface Active Agent)" (Ichirō Nishi et al., Sangyo Tosho (1960) pp.210–270). The surfactant may be added to either the oil phase or the aqueous phase. The amount of the surfactant employed is preferably from 0.1 to 5% by weight, especially from 0.5 to 2% by weight, based on the amount of the oil phase. Two or more surfactants may, of course, be used in combination.

Emulsification is accomplished by adding the oil phase to the aqueous phase which is continuously stirred with a high-shear stirring device such as a homogenizer. After emulsification, the reaction for forming capsule walls is accelerated by adding a catalyst for the polymerization reaction of the isocyanate compound or by elevating the temperature of the emulsion.

The diazonium salt compound-containing microcapsules obtained by the process of the present invention and having improved diazonium salt compound stability can be incorporated, for example, into a fixation-type heat-sensitive recording paper as described below.

A diazonium salt compound is encapsulated by the method described above. A coupler which reacts with the diazonium salt compound to form a dye is finely dispersed by converting the same into an emulsion or a suspension. Examples of the coupler include resorcinol, fluoroglucinol, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihydroxy-6-sulfanilnaphthalene, 2-hydroxy-3-naphthanilide, 2-hydroxy-3-naphthoic ethanolamide, 2-hydroxy-3-naphthoic octylamide, 2-hydroxy- 3-naphthoic N-dodecyloxypropylamide, 2-hydroxy-3-naphthoic tetradecylamide, acetanilide, acetoacetanilide, benzoylacetanilide, 2-chloro-5-octylacetoacetanilide, 1-phenyl- 3-methyl-5-pyrazolone, 1-(2'-octylphenyl)-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, 1-(2-dodecyloxyphenyl)-2-(methyl carbonato)cyclohexane-3,5-dione, 1-(2-dodecyloxyphenyl)cyclohexane-3,5-dione, N-phenyl-N'-dodecylbarbituric acid, and N-phenyl-N'-(3-stearyloxy)butylbarbituric acid. Two or more of these couplers may be used in combination to develop a desired hue.

In general, a basic compound is further added in order to accelerate the dye-forming reaction. In addition to an inorganic or organic base, the basic compound may be a compound which upon heating undergoes decomposition or another change to release an alkali. Representative examples of such a base precursor include nitrogen compounds such as organic ammonium salts, organic amines, amides, urea and thiourea and derivatives thereof, thiazole compounds, pyrrole compounds, pyrimidine compounds, piperazine compounds, guanidine compounds, indole compounds, imidazole compounds, imidazoline compounds, triazole compounds, morpholine compounds, piperidine compounds, amidine compounds, formamidine compounds, and pyridine compounds. Specific examples of such compounds include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl- 4-methylimidazole, 2-undecylimidazoline, 2,4,5-trifuryl- 2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, and 2-benzoylhydrazinobenzothiazole. Two or more of these may be used in combination.

In emulsifying a coupler and a basic substance, these compounds are dissolved in an organic solvent, and the solution thereof is added to an aqueous solution of a water-soluble polymer while the aqueous solution is continuously stirred with, e.g., a homogenizer. For accelerating particle size reduction, use of a surfactant is preferred. For these ingredients, use can be made of the same organic solvent, water-soluble polymer, and surfactant as used in the encapsulation described above.

In preparing a suspension of a coupler and a basic substance, a powder of the compounds is added to an aqueous solution of a water-soluble polymer and finely dispersed therein using a dispersing means such as a ball mill.

The fluids thus prepared are mixed in an appropriate proportion and applied to a substrate. In general, the coupler amount is from 1 to 10 mol, preferably from 2 to 6 mol, per mol of the diazonium salt compound. The optimum range of the amount of the basic compound to be added varies depending on its basicity, but is generally from 0.5 to 5 mol per mol of the diazonium salt compound.

As the substrate to which a heat-sensitive coating fluid comprising the above-described ingredients is to be applied, a known substrate is used. Examples thereof include paper, coated papers produced by coating paper with clay or the like, laminated papers produced by laminating polyethylene, polyesters, or the like to papers, synthetic papers, and synthetic resin supports made of polyethylene terephthalate, polyimides, triacetyl cellulose, etc.

If desired and necessary, a protective layer is further formed on the heat-sensitive recording layer by coating. Thus, a fixation-type heat-sensitive recording paper is completed.

By heating the recording side of the completed photo- and heat-sensitive recording paper with a thermal head or the like, the capsule walls made of a polyurea or polyurethane are softened and, as a result, the coupler and basic compound present outside the capsules penetrate into the capsules to develop a color. After color development, the resulting recording paper is irradiated with light having a wavelength which is an absorption wavelength of the diazonium salt compound. As a result, the diazonium salt compound is decomposed and loses its reactivity with the coupler to thereby fix the image. Alternatively, an image may be formed by first image-wise exposing the recording paper to the light to decompose the diazonium salt in the irradiated area and then evenly heating the resulting recording paper.

Examples of the present invention will be given below, but the invention is not construed as being limited thereto. In the Examples, all parts are by weight. (1) Preparation of Dispersions of Microcapsules Containing Diazonium Salt Compound and Preparation of Coupler Emulsion

EXAMPLE 1

In 20 parts of ethyl acetate was dissolved 2.8 parts of 4-N-hexyl-N'-(4-methoxyphenoxyisopropyl)amino-2hexylbenzenediazonium hexafluorophosphate as a diazonium salt compound. Thereto was added 8.4 parts of isopropyldiphenylethane as a high-boiling solvent. The resulting mixture was stirred with heating to give a homogeneous solution, which was then cooled to room temperature. To this solution was added 7.6 parts of a xylylene diisocyanate/trimethylolpropane adduct (75 wt% ethyl acetate solution) as an agent for forming capsule walls. After this mixture was stirred to give a homogeneous solution, 2.8 parts of di-n-butyl sulfate as the dialkyl sulfate compound of this invention was added thereto to prepare an oil phase serving as capsule cores. On the other hand, 2.0 parts of a 2wt% aqueous solution of sodium dodecylbenzenesulfonate as a surfactant for emulsification was added to 50 parts of an 8.0 wt% aqueous solution of phthalated gelatin to give a homogeneous solution. To this aqueous phase was added the oil phase prepared above. The resulting mixture was treated with a homogenizer (Type AM, manufactured by Nippon Seiki K. K., Japan) to emulsify the oil phase, thereby giving an emulsion having an average particle diameter of 0.4 μm. To the emulsion obtained was added 20 parts of warm water (about 40° C.). The resulting emulsion was heated to 40° C. and allowed to undergo an encapsulation reaction for 3 hours with gentle stirring. Thus, microcapsules having an average particle diameter of 0.4 μm were obtained.

Into 10 parts of ethyl acetate were then homogeneously dissolved 3 parts of N-phenyl-N'-(2,5-dioctoxyphenyl)barbituric acid as a coupler, 3 parts of triphenylguanidine as a basic compound, 3 parts of the compound represented by the following formula as a sensitizer, and 0.6 parts of tricresyl phosphate and 0.3 parts of diethyl maleate as high-boiling organic solvents to prepare an oil phase. On the other hand, 5 parts of 10 wt% aqueous sodium dodecylbenzenesulfonate solution as a surfactant for emulsification was added to and homogeneously dissolved in 60 parts of an 8 wt% aqueous gelatin solution. To this aqueous phase was added the oil phase obtained above. The resulting mixture was treated with a homogenizer to emulsify the oil phase, and then stirred at about 40° C. for 3 hours to evaporate the ethyl acetate. Thus, a coupler emulsion was obtained.

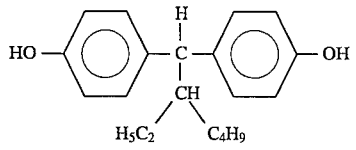

EXAMPLE 2

The same procedure as in Example 1 was carried out, except that diethyl sulfate was used in place of di-n-butyl sulfate in the same amount by weight.

EXAMPLE 3

The same procedure as in Example 1 was carried out, except that di-n-propyl sulfate was used in place of di-n-butyl sulfate in the same amount by weight.

EXAMPLE 4

The same procedure as in Example 1 was carried out, except that 4-chlorophenylthiobenzenediazonium hexafluorophosphate and 4-chloro-2,5-dibutoxypivaloylacetanilide were used as a diazonium salt and a coupler, respectively in the same amount by weight, respectively.

COMPARATIVE EXAMPLE 1

The same procedure as in Example 4 was carried out, except that di-n-butyl sulfate was not added.

COMPARATIVE EXAMPLE 2

The same procedure as in Example 4 was carried out, except that di-n-butyl sulfate was not added.

(2) Preparation of Coated Samples for Evaluation

Each of the microcapsule dispersions prepared in Examples 1, 2, 3, and 4 and Comparative Examples 1 and 2 was applied to a polyethylene-laminated paper in an amount of 0.16 g/m$^2$ in terms of the amount of the diazonium salt, and dried. Thus, coated samples (A1), (B1), (C1), and (D1) according to the present invention and comparative coated samples (El) and (F1) were prepared (coupler-free coated samples).

Furthermore, each of the microcapsule dispersions prepared in Examples 1, 2, 3, and 4 and Comparative Examples 1 and 2 was mixed with the coupler emulsion in such a proportion that the diazonium salt compound/coupler ratio was ½ by weight. Each mixture was applied to a polyethylenelaminated paper in an amount of 0.16 g/m$^2$ in terms of the amount of the diazonium salt, and dried. Thus, coated samples (A2), (B2), (C2), and (D2) according to the present invention and comparative coated samples (E2) and (F2) were prepared (coupler-containing coated samples).

(3) Accelerated Deterioration Test

The coated samples described above were stored for 72 hours in a constant temperature-humidity chamber regulated to have a temperature of 60° C. and a humidity of 30% RH, thereby accelerating the deterioration of the samples.

With respect to the coupler-containing coated samples, the thus-treated samples were heated with a color development tester (manufactured by Kyocera Corp., Japan) using a KST type thermal head (manufactured by Kyocera Corp.) and adjusting the electric power applied to the thermal head and the pulse width so as to become a recording energy per unit area to 0 to 40 mj/mm$^2$ to develop color. The resulting coated samples were sufficiently irradiated with light having a wavelength of 420 nm or 365 nm, which wavelength is an absorption wavelength of the diazonium salt, to decompose the diazonium salt to thereby fix the image.

The coated samples which had undergone the accelerated deterioration treatment were examined with a Macbeth densitometer to measure the density, and compared with untreated coated samples. In the density measurement with a Macbeth densitometer, the background density change was examined by measuring the yellow component and the cyan component, which components had undergone an especially great density change.

The results obtained are summarized in Tables 1 and 2. In these tables, "Additive" means a dialkyl sulfate compound.

TABLE 1

| | Coated Sample (coupler-free) | | Background Density Change | | | |
|---|---|---|---|---|---|---|
| | | | Yellow component | | Cyan component | |
| | Coated Sample | Additive | Before treatment | After treatment | Before treatment | After treatment |
| Example 1 | A1 | present | 0.06 | 0.08 | 0.03 | 0.04 |
| Example 2 | B1 | present | 0.06 | 0.09 | 0.03 | 0.05 |
| Example 3 | C1 | present | 0.06 | 0.10 | 0.03 | 0.05 |
| Comparative Example 1 | E1 | absent | 0.06 | 0.18 | 0.03 | 0.11 |
| Example 4 | D1 | present | 0.07 | 0.10 | 0.04 | 0.06 |
| Comparative Example 2 | F1 | absent | 0.07 | 0.13 | 0.04 | 0.09 |

TABLE 2

| | Coated Samlple (coupler-containing) | | | Background Density Change | | | | Maximum Color Density Change | |
|---|---|---|---|---|---|---|---|---|---|
| | | | | Yellow component | | Cyan component | | | |
| | Coated sample | Additive | Developed hue | Before treatment | After treatment | Before treatment | After treatment | Before treatment | After treatment |
| Example 1 | A2 | present | magenta | 0.07 | 0.09 | 0.04 | 0.05 | 1.45 | 1.40 |
| Example 2 | B2 | present | magenta | 0.07 | 0.10 | 0.04 | 0.06 | 1.45 | 1.37 |
| Example 3 | C2 | present | magenta | 0.07 | 0.11 | 0.04 | 0.06 | 1.45 | 1.35 |
| Comparative Example 1 | E2 | absent | magenta | 0.07 | 0.20 | 0.04 | 0.12 | 1.45 | 1.20 |
| Example 4 | D2 | present | yellow | 0.08 | 0.10 | 0.05 | 0.07 | 1.54 | 1.50 |
| Comparative Example 2 | F2 | absent | yellow | 0.08 | 0.14 | 0.05 | 0.10 | 1.54 | 1.23 |

Tables 1 and 2 show that the coated samples containing a dialkyl sulfate compound were inhibited from an increase in staining with time, had improved diazonium salt compound stability, and as a result underwent little decrease in maximum color density.

While the invention has been described in detail and with reference to specific embodiments thereof, it will be apparent to one skilled in the art that various changes and modifications can be made therein without departing from the spirit and scope thereof.

What is claimed is:

1. A process for producing microcapsules containing a diazonium salt compound which comprises adding a dialkyl sulfate compound represented by the following formula:

$$RO—SO_2—OR$$

wherein R represents an alkyl or cycloalkyl group having up to 24 carbon atoms, to an organic solvent solution containing both the diazonium salt compound and a polyfunctional isocyanate compound, emulsifying the resulting organic solvent solution into an aqueous solution of a water-soluble polymer, and then polymerizing the polyfunctional isocyanate compound to form microcapsule walls.

2. The process according to claim 1, wherein R is an alkyl group having from 2 to 12 carbon atoms.

3. The process according to claim 1, wherein R is an alkyl group having from 2 to 6 carbon atoms.

4. The process according to claim 1, wherein R is substituted by an aryl group, an alkoxyl group, an aryloxy group, an alkylthio group, an arylthio group, a nitro group or a halogen atom.

5. The process according to claim 1, wherein the dialkyl sulfate compound is diethyl sulfate, di-n-propyl sulfate, di-n-butyl sulfate, bis(2-ethylhexyl) sulfate, dilauryl sulfate, distearyl sulfate, bis(2-phenethyl) sulfate, bis(α-naphthylmethyl) sulfate, dibenzyl sulfate, bis(2-butoxyethyl) sulfate, bis(2-phenoxyethyl) sulfate, bis(2-octylthioethyl) sulfate, bis(2-(4-tolyl)thioethyl) sulfate, bis(4-nitroethyl) sulfate, bis(2-chloroethyl) sulfate, dicyclohexyl sulfate, bis(4-methylcyclohexyl) sulfate, bis(4-methoxycyclohexyl) sulfate, or bis(4-butylthiocyclohexyl) sulfate.

6. The process according to claim 1, wherein the dialkyl sulfate compound is present in an amount from 0.05 to 10 parts by weight per 1 part by weight of the diazonium salt compound.

7. The process according to claim 6, wherein the dialkyl sulfate compound is present in an amount from 0.2 to 3 parts by weight per 1 part by weight of the diazonium salt compound.

8. The process according to claim 6, wherein the diazonium salt compound is represented by the formula $$Ar—N_2^+X^-$$

wherein Ar represents an aromatic residue and $X^-$ represents an acid anion, and has a maximum absorption wavelength above 380 nm.

9. The process according to claim 1, wherein the polyfunctional isocyanate compound has 3 or more isocyanate groups per molecule.

10. The process according to claim 1, wherein the polyfunctional isocyanate compound is xylylene diisocyanate and the organic solvent is trimethylolpropane.

11. A photo- and heat-sensitive recording material comprising, a coupler, a basic compound, and microcapsules containing a diazonium salt compound, wherein the microcapsules are produced by a process comprising the steps of:

adding a dialkyl sulfate compound represented by the following formula:

$$RO—SO_2—OR$$

wherein R represents an alkyl or cycloalkyl group having up to 24 carbon atoms, to an organic solvent solution containing both the diazonium salt compound and a polyfunctional isocyanate compound, emulsifying the resulting organic solvent solution into an aqueous solution of a water-soluble polymer, and then polymerizing the polyfunctional isocyanate compound to form microcapsule walls.

12. The photo- and heat-sensitive recording material according to claim 11, wherein a protective layer is formed on the recording material.

13. The photo- and heat-sensitive recording material according to claim 11, wherein an image is formed by image-wise exposing the recording material to heat and then fixing the image by exposing the recording material to light, or by image-wise exposing the recording material to light and then fixing the image by exposing the recording material to heat.

14. The photo- and heat-sensitive recording material according to claim 11, wherein R is an alkyl group having from 2 to 12 carbon atoms, and is optionally substituted by an aryl group, an alkoxy group, an aryloxy group, an alkylthio group, an arylthio group, a nitro group or a halogen atom.

15. The photo- and heat-sensitive recording material according to claim 11, wherein the dialkyl sulfate compound is diethyl sulfate, di-n-propyl sulfate, di-n-butyl sulfate, bis(2-ethylhexyl) sulfate, dilauryl sulfate, distearyl sulfate, bis(2-phenethyl) sulfate, bis(α-naphthylmethyl) sulfate, dibenzyl sulfate, bis(2-butoxyethyl)sulfate, bis(2-phenoxyethyl)sulfate, bis(2-octylthioethyl) sulfate, bis(2-( 4-tolyl)thioethyl) sulfate, bis(4-nitroethyl)sulfate, bis(2-chloroethyl) sulfate, dicyclohexyl sulfate, bis(4-methylcyclohexyul) sulfate, bis(4-methoxycyclohexyl) sulfate, or bis(4-butylthiocyclohexyl) sulfate.

16. The photo- and heat-sensitive recording material according to claim 11, wherein the basic compound is an inorganic base, an organic base or a base precursor selected from the group consisting of nitrogen compounds, thiazole compounds, pyrrole comounds, pyrimidine compounds, piperazine compounds, guanidine compounds, indole compounds, imidazole compounds, imidazoline compounds, triazole compounds, morpholine compounds, piperidine compounds, amidine compounds, formamidine compounds and pyridine compounds.

17. The photo- and heat-sensitive recording material according to claim 11, wherein the polyfunctional isocyanate compound is xylylene diisocyanate and the organic solvent is trimethylolpropane.

18. The photo- and heat-sensitive recording material according to claim 11, wherein the dialkyl sulfate compound is present in an amount from 0.05 to 10 parts by weight per 1 part by weight of the diazonium salt compound; the coupler is present in an amount from 1 to 10 mol per mol of the diazonium salt compound; and the basic compound is present in an amount form 0.5 to 5 mol per mol of the diazonium salt compound.

* * * * *